US006379474B1

(12) United States Patent
Mayer et al.

(10) Patent No.: US 6,379,474 B1
(45) Date of Patent: Apr. 30, 2002

(54) PHOSPHATING METHOD ACCELERATED BY N-OXIDES

(75) Inventors: Bernd Mayer, Duesseldorf; Peter Kuhm, Hilden, both of (DE); Pietro Balboni, Bologna (IT); Markus Senner, Duesseldorf (DE); Horst-Dieter Speckmann, Langenfeld (DE); Juergen Geke, Duesseldorf (DE); Jan-Willem Brouwer, Willich (DE); Annette Willer, Neuss (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/485,274

(22) PCT Filed: Jul. 25, 1998

(86) PCT No.: PCT/EP98/04669

§ 371 Date: Jan. 10, 2001

§ 102(e) Date: Jan. 10, 2001

(87) PCT Pub. No.: WO99/07916

PCT Pub. Date: Feb. 18, 1999

(30) Foreign Application Priority Data

Aug. 6, 1997 (DE) ..... 197 33 978
Nov. 13, 1997 (DE) ..... 197 50 301

(51) Int. Cl.[7] ..... C23C 22/07

(52) U.S. Cl. ..... 148/260; 148/262; 106/14.12; 106/14.16; 106/14.17; 252/389.21

(58) Field of Search ..... 198/260, 262; 106/14.12, 14.16, 14.17; 252/389.21

(56) References Cited

U.S. PATENT DOCUMENTS

| | | | | |
|---|---|---|---|---|
| 3,876,371 A | * | 4/1975 | Costain et al. | 422/12 |
| 4,596,607 A | * | 6/1986 | Huff et al. | 428/472.3 |
| 5,268,041 A | | 12/1993 | Gehmecker et al. | 148/260 |
| 5,935,348 A | | 8/1999 | Rossmaier | 148/243 |

FOREIGN PATENT DOCUMENTS

| | | |
|---|---|---|
| DE | 40 13 483 | 10/1991 |
| DE | 42 10 513 | 10/1993 |
| DE | 44 41 710 | 5/1996 |
| EP | 0 315 059 | 5/1989 |
| GB | 510 684 | 8/1939 |

* cited by examiner

*Primary Examiner*—John Sheehan
*Assistant Examiner*—Andrew L. Oltmans
(74) *Attorney, Agent, or Firm*—Stephen D. Harper; Daniel S. Ortiz

(57) ABSTRACT

An acidic aqueous phosphating solution is presented having 0.2 to 3 g/l of zinc ions, 3 to 50 g/l of phosphate ions expressed as $PO_4^{-3}$, and 0.05 to 4 g/l of an organic N-oxide containing a saturated, unsaturated or aromatic 5- or 6-membered ring system, where the N atom of the N-oxide is part of said ring system, and where the ratio by weight of phosphate ions to zinc ions is from 3.7 to 30:1. The solution is free of hydroxylamine and useful in phosphating metal surfaces.

21 Claims, No Drawings

PHOSPHATING METHOD ACCELERATED BY N-OXIDES

This application is filed under 35 U.S.C. 371 and based on PCT/EP98/04669, filed Jul. 25, 1998.

BACKGROUND OF THE INVENTION

1. Field of the Invention

This invention relates to a phosphating solution, to a phosphating concentrate and to a process for phosphating metal surfaces with aqueous acidic phosphating solutions containing zinc and phosphate ions and at least one organic N-oxide and to their use for pretreating the metal surfaces for subsequent coating, more particularly electrodeposition coating. The process according to the invention may be used for treating surfaces of steel, galvanized or alloy-galvanized steel, aluminium, aluminized or alloy-aluminized steel 2. Discussion of Related Art The object of phosphating metals is to produce on the metal surface firmly intergrown metal phosphate coatings which improve resistance to corrosion and, in conjunction with paints and other organic coatings, lead to a significant increase in paint adhesion and in resistance to creepage in corrosive environments. Phosphating processes have long been known. Low-zinc phosphating processes where the phosphating solutions have comparatively low contents of zinc ions, for example 0.5 to 2 g/l, are particularly suitable for pretreatment in preparation for painting. A key parameter in low-zinc phosphating baths is the ratio by weight of phosphate ions to zinc ions which is normally of the order of >12:1 and can assume values of up to 30:1.

It has been found that phosphate layers with distinctly improved corrosion resistance and paint adhesion properties can be formed by using other polyvalent cations than zinc in the phosphating baths. For example, low-zinc processes where, for example, 0.5 to 1.5 g/l manganese ions and, for example, 0.3 to 2.0 g/l nickel ions are added are widely used as so-called trication processes for preparing metal surfaces for painting, for example for the cathodic electrodeposition painting of car bodies.

DE-A-40 13 483 describes phosphating processes with which it is possible to obtain corrosion resistance properties comparable with those achieved by the trication process. These processes use copper in low concentrations (0.001 to 0.03 g/l) instead of nickel. Oxygen and/or other similarly acting oxidizing agents are used to oxidize the divalent iron formed during the pickling of steel surfaces into the trivalent stage. The other similarly acting oxidizing agents mentioned include nitrite, chlorate, bromate, peroxy compounds and organic nitro compounds, such as nitrobenzene sulfonate. German patent application DE 42 10 513 modifies this process by adding hydroxylamine, salts or complexes thereof in a quantity of 0.5 to 5 g/l hydroxylamine to modify the morphology of the phosphate crystals formed.

The use of hydroxylamine and/or hydroxylamine compounds for influencing the form of the phosphate crystals is known from a number of published patent applications. According to EP-A-315 059, a particular effect of using hydroxylamine in phosphating baths is that the phosphate crystals are formed in a desirable columnar or nodal form on steel, even when the concentration of zinc in the phosphating bath exceeds the normal range for low-zinc processes.

Hydroxylamine has the major process-related advantage that it generally does not decompose on its own in the phosphating bath or in phosphating concentrates.

Accordingly, it is possible to produce phosphating bath concentrates and regenerating solutions for phosphating baths which directly contain the necessary quantities of accelerator. There is, therefore, no need for complicated subsequent addition of the accelerator in a separate step, as is necessary, for example, where nitrite or hydrogen peroxide is used as the accelerator. However, if the phosphating solution contains copper ions, which is a current trend in the art, hydroxylamine gradually decomposes under the catalytic influence of those ions. In this case, the accelerator has to be separately added to the phosphating bath in large quantifies. Accordingly, there is a need for new accelerators which can be incorporated similarly to hydroxylamine in phosphating baths, phosphating bath concentrates and regenerating solutions without decomposing after a short time. The phosphating baths, concentrates and regenerating solutions are expected to have this property even in the presence of copper ions.

The problem addressed by the present invention was to provide a phosphating process which would have the advantages of hydroxylamine-accelerated processes without any of their disadvantages in regard to decomposition in the presence of copper ions. The phosphating process would lend itself to application by spraying, spraying/dipping or dipping.

DESCRIPTION OF THE INVENTION

Accordingly, the present invention relates to an acidic aqueous phosphating solution containing 0.2 to 3 g/l zinc ions, 3 to 50 g/l phosphate ions expressed as $PO_4^{3-}$ and accelerators, characterized in that the solution contains 0.05 to 4 g/l of an organic N-oxide as accelerator.

Preferred organic N-oxides are those which have a saturated, unsaturated or aromatic 5- or 6-membered ring system and in which the N-atom of the N-oxide is part of that ring system. Examples of such compounds are the N-oxides of substituted or unsubstituted pyrroles, imidazoles, oxazoles, pyridines, pyrimidines, pyrazines, oxazines or hydrogenation products thereof which have saturated or partly unsaturated rings. It is particularly preferred to use N-oxides of substituted or unsubstituted pyridines and morpholines such as, in particular, pyridine-N-oxide, 2-methyl pyridine-N-oxide 4-methyl pyridine-N-oxide, morpholine-N-oxide and N-methyl morpholine-N-oxide. The last of these N-oxides is particularly preferred.

The phosphating solution may contain one or more of these N-oxides. The total concentration of the N-oxides in the phosphating solution is preferably in the range from 0.1 to 3 g/l and more preferably in the range from 0.3 to 2 g/l. With lower concentrations, the accelerating effect diminishes; higher concentrations are harmless, but do not afford any technical advantage and are therefore uneconomical.

Besides zinc ions, phosphating baths generally contain sodium, potassium and/or ammonium ions for adjusting the free acid. The concept of the free acid is familiar to the expert on phosphating. The method selected in this specification to determine the free acid and the total acid is described in the Examples. Free acid values of 0 to 1.5 points and total acid values of about 15 to about 35 points are in the technically normal range and are suitable for the purposes of the present invention.

The zinc contents are preferably in the range from 0.4 to 2 g/l and more preferably in the range from 0.5 to 1.5 g/l which is normal for low-zinc processes. The ratio by weight of phosphate ions to zinc ions in the phosphating baths may vary within wide limits providing it is in the range from 3.7 to 30:1. A ratio by weight of 10 to 20:1 is particularly preferred.

It has been found in practice that, where an organic N-oxide is used as accelerator in accordance with the present invention, it is advisable to use relatively highly concentrated activating solutions for the activation step normally preceding the phosphating process. However, if the organic N-oxide is supplemented by a suitable co-accelerator, activation may be carried out in the usual way.

Accordingly, a phosphating solution according to the invention additionally containing about 0.3 to about 4 g/l chlorate ions is preferably used. The chlorate concentration is preferably in the range from 1 to 3 g/l. Instead of or together with the chlorate ions, the phosphating solution may contain one or more of the following accelerators in addition to the organic N-oxide:

0.003 to 0.03 and preferably 0.005 to 0.015 g/l hydrogen peroxide in free or bound form, 0.2 to 1 and preferably 0.25 to 0.5 g/l nitroguanidine, 0.15 to 0.8 and preferably 0.2 to 0.5 g/l m-nitrobenzene sulfonate ions.

Hydrogen peroxide may be added as such to the phosphating solution. However, it may also be used in bound form in the form of compounds which form or eliminate hydrogen peroxide in the phosphating bath. Examples of such compounds are perborates, percarbonates, salts of peroxo acids such as, for example, peroxodisulfate or peroxides such as, for example, sodium or potassium peroxide.

Chlorate ions and/or m-nitrobenzene sulfonate ions are preferably used in the form of their water-soluble salts, for example their alkali metal salts.

Phosphating solutions containing other monovalent or divalent metal ions, which have been found by experience to have a favorable effect on the paint adhesion and corrosion prevention of the phosphate layers produced, are preferably used in the phosphating process according to the invention. In a preferred embodiment, therefore, the phosphating solution according to the invention additionally contains one or more of the following cations:

0.1 to 4 g/l manganese(II), 0.2 to 2.5 g/l magnesium(II), 0.2 to 2.5 g/l calcium(II), 0.002 to 0.2 g/l copper(II), 0.1 to 2 g/l cobalt(II).

If desired, the phosphating solutions may additionally contain nickel ions. However, phosphating baths which have minimal contents of nickel ions or, if desired, may even be nickel-free are preferred for health reasons and ecological reasons.

In one preferred embodiment, for example, the phosphating solution according to the invention contains 0.1 to 4 g/l manganese ions and 0.002 to 0.2 g/l copper ions and no more than 0.05 g/l and, in particular, no more than 0.001 g/l nickel ions as additional cations besides zinc ions. However, if it is desired to stay with the conventional trication technology, phosphating baths according to the invention containing 0.1 to 4 g/l, manganese ions and in addition 0.1 to 2.5 g/l nickel ions besides zinc ions may be used. In principle, the form in which the cations are introduced into the phosphating baths is of no relevance. However, it is particularly appropriate to use oxides and/or carbonates as the cation source.

In the phosphating of zinc-containing surfaces, it has proved to be favorable to limit the nitrate content of the phosphating bath to at most 0.5 g/l. This suppresses the problem of so-called fisheye formation and improves protection against corrosion, particularly where nickel-free phosphating baths are used. Nitrate-free phosphating baths are particularly preferred.

In the case of phosphating baths intended to be suitable for various substrates, it has become standard practice to add free and/or complexed fluoride in quantities of up to 2.5 g/l total fluoride, including up to 750 mg/l free fluoride, expressed as $F^-$. The presence of fluoride in such quantities is also of advantage for the phosphating baths according to the invention. In the absence of fluoride, the aluminium content of the bath should not exceed 3 mg/l. In the presence of fluoride, higher Al contents are tolerated as a result of complexing providing the concentration of the non-complexed Al does not exceed 3 mg/l.

In principle, phosphating baths may be prepared by dissolving the individual components in water in situ in the required concentration range. In practice, however, it is normal to use concentrates which contain the individual constituents in the required quantities and from which the ready-to-use phosphating bath is prepared in situ by dilution with water or which are added as a regenerating solution to a working phosphating bath in order to compensate for the consumption of active components. However, phosphating concentrates such as these are adjusted to a highly acidic pH for stabilization. After dilution with water, therefore, the pH value and/or the free acid has to be neutralized fairly often to the required range. Alkaline substances such as, for example, sodium hydroxide or sodium carbonate or basic salts or hydroxides of Ca, Mg, Zn are added for this purpose.

Accordingly, the present invention also relates to an aqueous concentrate which, after dilution with water by a factor of 10 to 100 and optionally after pH adjustment to a working range of 2.5 to 3.6, gives a phosphating solution of the type claimed in one or more of claims 1 to 13.

The present invention also relates to a process for phosphating metal surfaces of steel, galvanized or alloy-galvanized steel and/or of aluminium. The materials mentioned may also be present alongside one another, as is increasingly the case in car manufacture. The metal surfaces are contacted with the phosphating solution according to the invention by spraying or dipping or by a combination thereof. The temperature of the phosphating solution is preferably in the range from about 40 to about 60° C.

The phosphating process may be used for phosphating steel or galvanized steel strip in strip mills. The phosphating times are of the order of about 3 to about 20 seconds. However, the process may be used in particular in the automotive industry where treatment times of 1 to 8 minutes are normal. It is particularly intended for the treatment of the above-mentioned metal surfaces in preparation for painting, more particularly cathodic electrodeposition painting. The phosphating process may be regarded as part of the normal pretreatment chain. Within this chain, phosphating is generally preceded by cleaning/degreasing, intermediate rinsing and activation steps, activation normally being carried out with titanium phosphate activators. The phosphating treatment according to the invention may be followed, optionally after rinsing, by a passivating aftertreatment. Chromic acid treatment baths are widely used for such an aftertreatment. However, in the interests of safety at work and environmental protection and for reasons of waste disposal, there is a tendency to replace these chromium-containing passivating baths by chromium-free treatment baths. Pure inorganic baths, more particularly based on zirconium compounds, and even organic baths, for example based on poly (vinylphenols), are known for this purpose. Where phosphating solutions containing neither nickel nor copper ions are used, a distinct improvement in corrosion prevention can be obtained by adding copper or silver ions to the baths for the passivating aftertreatment. For example, passivating after-rinse solutions which contain 0.001 to 10 g/l copper ions and which if desired may be free from other passivating components may be used. In general, an intermediate rinse with deionized water is carried out between this after-passivation step and the subsequent electrodeposition painting process.

EXAMPLES

Examples 1–7.

Comparison Examples 1 and 2

The phosphating processes according to the invention and comparison processes were tested on steel plates (St 1405) of the type used in car manufacture. The following process steps—normal in body assembly—were carried out by spraying:

1. Cleaning with an alkaline cleaner (Ridoline® 1559, Henkel KGaA), 4% in mains water, 60° C., 4 minutes.
2. Rinsing with mains water, room temperature, 1 minute.
3. Activation with a titanium phosphate activator (Fixodine® 9112, Henkel KGaA), 0.2% in deionized water, room temperature, 1 minute.
4. Phosphating with phosphate baths having the following composition:
   1.0 g/l $Zn^{2+}$
   0.8 g/l $Mn^{2+}$
   0.5 g/l $Ni^{2+}$
   0.05 g/l $Fe^{2+}$
   14 g/l phosphate, expressed as $PO_4^{3-}$
   accelerator according to Table 1
   pH: 3.3; free acid: 0.9; total acid: 23
   temperature: 55° C.; treatment time: 3 minutes' spraying.

For all the Examples and Comparison Examples, the free acid point count is understood to be the quantity in ml of 0.1-normal sodium hydroxide consumed in titrating 10 ml of bath solution to a pH value of 3.6. Similarly, the total acid point count is the consumption in ml to a pH value of 8.2. Exceptions to this definition (Examples 19–31, Comparison Examples 6–11) are indicated there.

5. Rinsing with mains water, room temperature, 1 minute.
6. Blow-drying with compressed air.

The weight per unit area ("layer weight") was determined by dissolution in 5% chromic acid solution in accordance with DIN 50942.

TABLE 1

Accelerators and phosphating results

| Example No. | Accelerator | Concentration (g/l) | Layer weight ($g/m^2$) | Layer appearance[1)] |
|---|---|---|---|---|
| Comp. 1 | None | | 1.5 | – |
| Comp. 2 | Hydroxylammonium sulfate | 2.0 | 3.3 | ++ |
| Example 1 | N-Methyl morpholine-N-oxide | 0.5 | 4.9 | + |
| Example 2 | N-Methyl morpholine-N-oxide | 1 | 3.1 | ++ |
| Example 3 | 4-Picoline-N-oxide | 0.5 | 4.4 | + |
| Example 4 | 4-Picoline-N-oxide | 1 | 3.5 | ++ |
| Example 5 | Pyridine-N-oxide | 0.5 | 4.5 | + |

TABLE 1-continued

Accelerators and phosphating results

| Example No. | Accelerator | Concentration (g/l) | Layer weight ($g/m^2$) | Layer appearance[1)] |
|---|---|---|---|---|
| Example 6 | Pyridine-N-oxide | 1 | 3.8 | + |
| Example 7 | Pyridine-N-oxide | 1.5 | 2.9 | ++ |

[1)]Layer appearance:
– very coarsely crystalline, non-uniform, non-compact
+ coarsely crystalline, slightly non-uniform, only partly compact
++ finely crystalline, uniform, compact.

Examples 8 to 14

Comparison Examples 3 and 4

The accelerating effect and stability of the accelerators according to the invention was tested in nickel-free copper-containing phosphating baths. The general process sequence corresponded to Examples 1 to 7. Baths of the following composition were used for phosphating:

1.0 g/l $Zn^{2+}$
0.8 g/l $Mn^{2+}$
0.007 g/l $Cu^{2+}$
0.01 g/l $Fe^{2+}$
15 g/l phosphate, expressed as $PO_4^{3-}$
accelerator according to Table 2
pH: 3.3; free acid: 0.9; total acid: 25
temperature: 55° C.; treatment time: 3 minutes' spraying In order to test the stability of the accelerators according to the invention against copper ions, the accelerator concentration was measured immediately after preparation of the phosphating bath. Three steel plates were then phosphated immediately afterwards. The phosphating results are set out in Table 2. After the phosphating of the three test plates, the phosphating bath was stirred with a magnetic stirrer for 24 hours at a temperature of 55° C. so intensively that air was taken into the phosphating bath through the stirrer funnel. The accelerator concentration was then remeasured.

Hydroxylamine was determined by the standard acetone method: (1) the bath solution diluted in a ratio of 1:20 is adjusted to a pH of 3.76 with 0.1 n NaOH, 10 ml of acetone are added and (2) the pH is readjusted to 3.76 with 0.1 n NaOH. Consumption (2) in ml×0.033=% hydroxylamine in the bath. In Table 2, the content is converted into hydroxylammonium sulfate. The N-oxides were determined by high-pressure liquid chromatography (HPLC).

TABLE 2

Accelerators, accelerator stability, phosphating results

| Example No. | Accelerator | Initial concentration (g/l) | Concentration after ageing (g/l) | Appearance of layer[1)] | Layer weight (g/l) |
|---|---|---|---|---|---|
| Comp. 3 | Hydroxylamine sulfate | 2 g/l | — | ++ | 3.7 |
| Comp. 4 | Hydroxylamine sulfate | 1.5 | — | ++ | 4.0 |
| Ex. 8 | N-methyl morpholine-N-oxide | 2.0 | 1.9 | ++ | 3.1 |

TABLE 2-continued

Accelerators, accelerator stability, phosphating results

| Example No. | Accelerator | Initial concentration (g/l) | Concentration after ageing (g/l) | Appearance of layer[1)] | Layer weight (g/l) |
|---|---|---|---|---|---|
| Ex. 9 | N-methyl morpholine-N-oxide | 1.5 | 1.45 | ++ | 3.2 |
| Ex. 10 | N-methyl morpholine-N-oxide | 1.0 | 0.9 | ++ | 3.0 |
| Ex. 11 | 4-Picoline-N-oxide | 2.5 | 2.4 | ++ | 2.9 |
| Ex. 12 | 4-Picoline-N-oxide | 1.5 | 1.4 | ++ | 3.4 |
| Ex. 13 | 4-Picoline-N-oxide | 0.75 | 0.7 | ++ | 4.1 |
| Ex. 14 | 4-Picoline-N-oxide | 0.4 | 0.4 | + | 4.5 |

[1)]cf. Table 1

Example 15

Comparison Example 5

The typical automotive substrates cold-rolled steel St 1405 (CRS), steel electrolytically galvanized on both sides (EG) and steel hot-dip-galvanized on both sides (HDG) were used for these Examples. The following process steps were carried out:

1) Cleaning with an alkaline cleaner (Ridoline® 1401, Henkel KGaA), 5% in mains water, 75° C., 5 minutes immersion.
2) Rinsing with mains water, room temperature, 1 minute.
3) Activation with a liquid titanium phosphate activator (Fixodine® 50 CF, Henkel KGaA), 0.05% in deionized water, room temperature, 1 minute's immersion.
4) Phosphating with a phosphate bath having the following composition:
   1.2 g/l $Zn^{2+}$,
   0.76 g/l $Mn^{2+}$,
   0.007 g/l $Cu^{2+}$,
   12.5 g/l $PO_4^{3-}$,
   2.7 g/l 25% by weight $H_2SiF_6$ solution,
   2 g/l N-methyl morpholine-N-oxide,
   free acid: 0.9; total acid: 23,
   temperature: 54° C.; 3 minutes' immersion.
5) Rinsing with deionized water, room temperature, 1 minute.
6) Blow-drying with compressed air.
7) Painting, cathodic electrodeposition paint Cathoguard 400 and Aufbau DB, metallic silver.

On cold-rolled steel, the composition of the layer was determined by atomic absorption spectroscopy after dissolution. The following ratios by weight of the metals were found: Zn:Mn:Cu=160:25:1.

A standard automotive alternating climate test (VDA 621–415) was carried out with painted steel plates. For evaluation, paint creepage at a score (half score width) was measured and the degree of corrosion was determined by a chipping test to the VW standard (scale values from 1 to 10 according to increasing corrosion).

Comparison Example 5 differs from Example 15 in that 2 g/l hydroxylammonium sulfate was used as accelerator instead of N-morpholine-N-oxide.

After the phosphating of cold-rolled steel, the following metal ratio was determined in the phosphate layer: Zn:Mn:Cu=140:22:1.

The results are set out in Table 3. The two tests clearly show that the phosphating results obtained where N-morpholine-N-oxide is used as accelerator in accordance with the invention are not significantly different from those obtained with the known accelerator hydroxylammonium sulfate.

TABLE 3

Phosphating results

| Substrate | Layer weight ($g/m^2$) | Crystal size ($\mu m$) | Paint creepage (U/2, mm) | Chipping test (K-value) |
|---|---|---|---|---|
| | | Example 15 | | |
| CRS | 3.3 | 3 to 7 | 0.95 | 1 |
| EG | 4.6 | 3 to 5 | 2.45 | 1.5 |
| HDG | 4.2 | 2 to 6 | 2.95 | 2 |
| | | Comparison 5 | | |
| CRS | 2.6 | 3 to 5 | 0.85 | 1 |
| EG | 4.1 | 3 to 7 | 2.5 | 1 |
| HDG | 4.5 | 5 to 9 | 2.85 | 2.5 |

Examples 16, 17, 18

Cold-rolled steel was phosphated by the following process steps:

1) Cleaning with an alkaline cleaner (Ridoline® 1559, Henkel KGaA), 2.5% in mains water, 75° C., 5 minutes immersion.
2) Rinsing with mains water, room temperature, 1 minute.
3) Activation with a liquid titanium phosphate activator (Fixodine® 50 CF, Henkel KGaA), 0.05% in deionized water, room temperature, 30 seconds' spraying, spraying pressure 1 bar.
4) Phosphating with phosphating baths according to Table 4, 52° C., 30 seconds' spraying, spraying pressure 1 bar. In addition to the components listed in Table 4, the phosphating baths contained various quantities of complexed fluoride ($H_2SiF_6$) and had different free acid and total acid values. These are set out in Table 5 together with the layer weights obtained and the appearance of the phosphate layers (as investigated by scanning electron microscopy).
5) rinsing with mains water, room temperature, 1 minute
6) blow-drying with compressed air.

TABLE 4

Phosphating solutions (composition in g/l)

| Component (g/l) | Example 16 | Example 17 | Example 18 |
|---|---|---|---|
| $H_3PO_4$ 85% | 18.15 | 18.15 | 18.15 |
| $Zn^{2+}$ | 1.3 | 1.3 | 0.85 |
| $Mn^{2+}$ | 1.05 | 1.05 | 0.8 |
| $Fe^{2+}$ | 0.03 | 0.03 | 0.03 |
| $Ni^{2+}$ | — | 0.4 | — |
| N-Methyl morpholine-N-oxide | 2 | 2 | 2 |

TABLE 5

Phosphating parameters and results

| Phosphating solution | $F^-$ (free) $F^-$ (complex) (ppm) | Free acid (points) | Total acid (points) | Layer weight ($g/m^2$) | Appearance |
|---|---|---|---|---|---|
| Example 16 | — 1500 | 0.7 | 20.3 | 1.22 | Almost compact |
| Example 16 | — 1500 | 0.35 | 19.8 | 1.38 | Compact, crystals 5–10 μm |
| Example 16 | — 1500 | 0.15 | 18.4 | 1.82 | Compact |
| Example 16 | — 2500 | 0.38 | 21.2 | 1.22 | Compact, crystals 4–8 μm |
| Example 16 | — 2500 | 0.2 | 20.9 | 1.53 | Compact |
| Example 16 | — 2500 | 0.15 | 20.8 | 1.84 | Compact |
| Example 16 | 150 2500 | 0.3 | 21.5 | 1.22 | Compact, crystals 4–8 μm |
| Example 16 | 150 2500 | 0.15 | 20.8 | 1.84 | Compact |
| Example 17 | — 1500 | 0.5 | 22.2 | 1.95 | Compact |
| Example 17 | — 1500 | 0.3 | 21.7 | 3.34 | Compact, crystals 4–8 μm |
| Example 17 | — 1500 | 0.36 | 21.8 | 1.85 | Compact, crystals 4–8 μm |

The phosphating solution for Example 18 is included in Table 4. It additionally contained 1750 ppm of complexed fluoride ($H_2SiF_6$). The substrates CRS, EG and HDG were phosphated with this solution at temperatures of 45° C. and 50° C. by the sequence of process steps mentioned above. The layer weights are set out in Table 6. In every case, visually satisfactory layers were obtained.

TABLE 6

Phosphating parameters and results
Phosphating solution of Example 18

| Temperature (° C.) | Free acid (points) | Total acid (points) | Substrate | Layer weight ($g/m^2$) |
|---|---|---|---|---|
| 45 | 0.2 | 19.3 | CRS | 2.60 |
| | | | EG | 1.81 |
| | | | HDG | 2.71 |
| 50 | 0.5 | 19.6 | CRS | 1.55 |
| | | | EG | 1.53 |
| | | | HDG | 2.07 |

Examples 19–31

Comparison Examples 6–11

The phosphating processes according to the invention and comparison processes were tested on steel plates (St 1405) of the type used in car manufacture. The following process steps—normal in body assembly—were carried out by spraying:

1. Cleaning with an alkaline cleaner (Ridoline® 1559, Henkel KGaA), 2% in mains water, 58° C., 5 minutes.
2. Rinsing with mains water, room temperature, 1 minute.
3. Activation with a titanium phosphate activator (Fixodine® 9112, Henkel KGaA), 0.1 or 0.5% in deionized water, room temperature, 1 minute.
4. Phosphating with phosphating baths having the following composition:
   1.2 g/l $Zn^{2+}$
   0.8 g/l $Mn^{2+}$
   0.007 g/l $Cu^{2+}$
   0.68 g/l $SiF_6^{2-}$
   0.8 g/l $F^-$
   14 g/l phosphate, expressed as $PO_4^{3-}$
   accelerator according to Tables 7 to 10
   pH: 3.3; free acid: Tables 7 to 10; total acid: 21
   temperature: 50° C.; treatment time: 4 minutes' immersion.

The free acid points count is understood to be the quantity in ml of 0.1 normal sodium hydroxide consumed in titrating 10 ml of bath solution to a pH of 3.6. Similarly, the total acid points count is the consumption in ml to a pH value of 8.5.5.

5. Rinsing with mains water, room temperature, 1 minute.
6. Blow-drying with compressed air.

The weight per unit area ("layer weight") was determined by dissolution in 5% chromic acid solution in accordance with DIN 50942.

TABLE 7

Variable bath parameters and layer weights

| Example No. | Concentration of activating solution (% by weight) | N-Methyl morpholine-N-oxide (g/l) | Chlorate (g/l) | Free acid (points) | Layer weight ($g/m^2$) |
|---|---|---|---|---|---|
| Comp. 6 | 0.1 | 0 | 3 | 0.7 | n.c.[1)] |
| Example 19 | 0.1 | 2 | 3 | 0.7 | 2.8 |
| Example 20 | 0.1 | 2 | 3 | 1.2 | 3.2 |
| Comp. 17 | 0.5 | 0 | 3 | 0.7 | n.c. |
| Example 21 | 0.5 | 2 | 3 | 0.7 | 2.3 |
| Example 22 | 0.5 | 2 | 3 | 1.2 | 2.5 |

[1)]n.c. = layer not compact

TABLE 8

Variable bath parameters and layer weights

| Example No. | Concentration of activating solution (% by weight) | N-Methyl morpholine-N-oxide (g/l) | $H_2O_2$ (ppm) | Free acid (points) | Layer weight ($g/m^2$) |
|---|---|---|---|---|---|
| Comp. 8 | 0.1 | — | 15 | 0.6 | n.c.[1)] |
| Example 23 | 0.1 | 2 | 5 | 0.6 | 3.2 |
| Example 24 | 0.1 | 2 | 10 | 0.6 | 2.8 |
| Example 25 | 0.1 | 2 | 15 | 0.6 | 2.0 |
| Example 26 | 0.1 | 2 | 20 | 0.6 | 1.5 |

[1)]= Layer not compact

TABLE 9

Variable bath parameters and layer weights

| Example No. | Concentration of activating solution (% by weight) | N-Methyl morpholine-N-oxide (g/l) | Chlorate (g/l) | Free acid (points) | Layer weight ($g/m^2$) |
|---|---|---|---|---|---|
| Comp. 9 | 0.1 | — | 400 | 0.8 | n.c.[1)] |
| Comp. 10 | 0.1 | — | 500 | 0.8 | 3.0 |
| Example 27 | 0.1 | 2 | 300 | 0.8 | 2.6 |
| Example 28 | 0.1 | 2 | 400 | 0.8 | 2.3 |

[1)]= Layer not compact

TABLE 10

| Variable bath parameters and layer weights | | | | | |
|---|---|---|---|---|---|
| Example No. | Concentration of activating solution (% by weight) | N-Methyl morpholine-N-oxide (g/l) | m-Nitrobenzene sulfonate (ppm) | Free acid (points) | Layer weight ($g/m^2$) |
| Comp. 11 | 0.1 | — | 450 | 0.8 | n.c.[1)] |
| Example 29 | 0.1 | 2 | 150 | 0.8 | 2.4 |
| Example 30 | 0.1 | 2 | 300 | 0.8 | 2.2 |
| Example 31 | 0.1 | 2 | 450 | 0.8 | 2.0 |

[1)]= Layer not compact

What is claimed is:

1. An acidic aqueous phosphating solution comprising:

a) 0.2 to 3 g/l zinc ions;

b) 3 to 50 g/l phosphate ions expressed as $PO_4^{-3}$; and c) 0.05 to 4 g/l of an organic N-oxide accelerator containing a saturated, unsaturated or aromatic 5- or 6-membered ring system, wherein th N atom of the N-oxide is pat of said ring system, and wherein the ratio by weight of phosphate ions to zinc ions is from 3.7 to 30:1.

2. The phosphating solution of claim 1 wherein said organic N-oxide is selected from the group consisting of N-oxides of substituted or unsubstituted pyrroles, imidazoles, oxazoles, pyradines, pyrimidines, pyrazines oxazines, morpholines, hydrogenation products thereof, and mixtures thereof.

3. The phosphating solution of claim 1 wherein said N-oxide is selected from the group consisting of N-oxides of substituted or unsubstituted pyridines, morpholines, and mixtures thereof.

4. The phosphating solution of claim 1 wherein said N-oxide is selected from the group consisting of pyridine-N-oxide, 2-methyl pyridine-N-oxide, 4methyl pyridine-N-oxide, morpholine-N-oxide, N-methyl morpholine-N-oxide, and mixtures thereof.

5. The phosphating solution of claim 1 comprising 0.1 to 3 g/l of said organic N-oxide.

6. The phosphating solution of claim 5 comprising 0.3 to 2 g/l of said organic N-oxide.

7. The phosphating solution of claim 1 further comprising 0.3 to 4 g/l chlorate ions.

8. The phosphating solution of claim 7 comprising 1 to 3 g/l chlorate ions.

9. The phosphating solution of claim 1 further comprising one or more additional accelerators selected from the group consisting of 0.003 to 0.03 g/l hydrogen peroxide in free or bound form, 0.2 to 1 g/l nitroguanidine, and 0.15 to 0.8 g/l m-nitrobenzene sulfonate ions.

10. The phosphating solution of claim 1 further comprising one or more cations selected from the group consisting of 0.1 to 4 g/l manganese(II), 0.2 to 2.5 g/l magnesium(II), 0.2 to 2.5 g/l calcium(II), 0.002 to 0.2 g/l copper(II), and 0.1 to 2 g/l cobalt(II).

11. The phosphating solution of claim 10 comprising 0.1 to 4 g/l manganese ions, 0.002 to 0.2 g/l copper ions, and no more than 0.05 g/l nickel ions.

12. The phosphating solution of claim 10 comprising 0.1 to 4 g/l manganese ions, and 0.1 to 2.5 g/l nickel ions.

13. The phosphating solution of claim 1 comprising 0.4 to 2 g/l zinc ions.

14. The phosphating solution of claim 13 comprising 0.5 to 1.5 g/l zinc ions.

15. The phosphating solution of claim 1 wherein said solution contains no more than 0.5 g/l of nitrate ions.

16. The phosphating solution of claim 1 further comprising free and/or complex fluoride in quantities of up to 2.5 g/l total fluoride, including up to 750 mg/l free fluoride.

17. An aqueous concentrate which forms the phosphating solution of claim 1 after dilution with water by a factor of 10 to 100.

18. The phosphate solution formed from said aqueous concentrate of claim 17 having a pH adjusted to a working range of 2.5 to 3.6.

19. A process for phosphating metal surfaces of steel, galvanized or alloy-galvanized steel, or of aluminium, comprising contacting said metal surfaces with the phosphating solution of claim 1.

20. The process of claim 19 wherein said phosphating solution is contacted with said metal by spraying, dipping, or by a combination thereof over a period of 3 seconds to 8 minutes.

21. The process of claim 19 wherein the temperature of said phosphating solution is from 40–60° C.

* * * * *

UNITED STATES PATENT AND TRADEMARK OFFICE

CERTIFICATE OF CORRECTION

PATENT NO. : 6,379,474 B1
DATED : April 30, 2002
INVENTOR(S) : Mayer et al.

It is certified that error appears in the above-identified patent and that said Letters Patent is hereby corrected as shown below:

Column 11,
Line 22, delete “th”; and insert therefor -- the --.
Line 23, delete “pat”; and insert therefor -- part --.
Line 29, delete “pyradines”; and insert therefor -- pyridines --.

Signed and Sealed this

Twenty-seventh Day of August, 2002

*Attest:*

*Attesting Officer*

JAMES E. ROGAN
*Director of the United States Patent and Trademark Office*